US009816052B2

(12) United States Patent
Grimm

(10) Patent No.: US 9,816,052 B2
(45) Date of Patent: Nov. 14, 2017

(54) CANDLES COMPRISING VEGETABLE OIL THAT IS LOW IN POLYUNSATURATION AND GELLING AGENT

(71) Applicant: CL PRODUCTS INTERNATIONAL, LLC, Cincinnati, OH (US)

(72) Inventor: Russell A. Grimm, Hillsboro, OH (US)

(73) Assignee: Candle-Lite Company, LLC, Cincinnati, OH (US)

( * ) Notice: Subject to any disclaimer, the term of this patent is extended or adjusted under 35 U.S.C. 154(b) by 0 days.

(21) Appl. No.: 14/999,058

(22) Filed: Mar. 24, 2016

(65) Prior Publication Data

US 2016/0281030 A1 Sep. 29, 2016

Related U.S. Application Data

(60) Provisional application No. 62/138,138, filed on Mar. 25, 2015.

(51) Int. Cl.
*C11C 5/00* (2006.01)

(52) U.S. Cl.
CPC ..... *C11C 5/002* (2013.01)

(58) Field of Classification Search
CPC combination set(s) only.
See application file for complete search history.

(56) References Cited

U.S. PATENT DOCUMENTS 3,645,705 A 2/1972 Miller et al.
5,527,845 A 6/1996 Strelow et al.
5,595,965 A 1/1997 Wiggins
5,843,194 A 12/1998 Spaulding
5,858,934 A 1/1999 Wiggins et al.
5,883,209 A 3/1999 Nakano et al.
5,981,781 A 11/1999 Knowlton
6,172,122 B1 1/2001 Lawate et al.
7,256,329 B2 8/2007 Fillatti
7,491,854 B2 2/2009 Binder
7,566,813 B2 7/2009 Voelker et al.
7,601,888 B2 10/2009 Fillatti et al.
7,790,953 B2 9/2010 Fillatti et al.
(Continued)

FOREIGN PATENT DOCUMENTS

CA 2457158 C 12/2010
CA 2694662 C 4/2014
(Continued)

OTHER PUBLICATIONS

International Search Report and Written Opinion dated May 13, 2016 for Application No. PCT/US2016/023695, 9 pgs.
(Continued)

*Primary Examiner* — Vishal Vasisth
*Assistant Examiner* — Chantel Graham
(74) *Attorney, Agent, or Firm* — Frost Brown Todd LLC

(57) ABSTRACT

Candle products may be made from a fuel source that contains a high oleic vegetable oil and a gelling agent. The high oleic vegetable oil may contain by weight percentage a fatty acid content of free fatty acids and/or fatty acids bound in triglyceride form, of: greater than 50% and less than about 99% of C18:1; and a combined C18:2 and C18:3 content of less than about 30%. Useful gelling agents may include fatty alcohols, fatty acids, dicarboxylic acids and combinations thereof.

21 Claims, 2 Drawing Sheets

(56) References Cited

U.S. PATENT DOCUMENTS

| | | | | |
|---|---|---|---|---|
| 7,943,818 | B2 | 5/2011 | Fillatti et al. | |
| 8,329,989 | B2 | 12/2012 | Wagner et al. | |
| 8,476,193 | B2 | 7/2013 | Keeney et al. | |
| 8,486,479 | B2 | 7/2013 | Higgins et al. | |
| 8,796,191 | B2 | 8/2014 | Denis et al. | |
| 2004/0044124 | A1 | 3/2004 | Hutter et al. | |
| 2005/0232974 | A1 | 10/2005 | Gore | |
| 2008/0307696 | A1 | 12/2008 | Wu et al. | |
| 2008/0319217 | A1 | 12/2008 | Ingrisch et al. | |
| 2009/0130289 | A1 | 5/2009 | Kincs | |
| 2009/0197975 | A1 | 8/2009 | Lien et al. | |
| 2013/0129654 | A1 | 5/2013 | Litvin et al. | |
| 2013/0236843 | A1* | 9/2013 | Kosovski-Shahor | C11C 5/002 431/288 |
| 2014/0013867 | A1 | 1/2014 | Perez et al. | |
| 2014/0230314 | A1* | 8/2014 | Murphy | C11C 5/023 44/275 |

FOREIGN PATENT DOCUMENTS

| | | | |
|---|---|---|---|
| CN | 101392211 | A | 3/2009 |
| CN | 103417478 | A | 12/2013 |
| EP | 0 106 923 | B1 | 1/1987 |
| EP | 0 174 042 | B1 | 6/1988 |
| EP | 0 685 554 | A1 | 12/1995 |
| EP | 0 923 304 | A1 | 6/1999 |
| EP | 1 077 613 | A1 | 2/2001 |
| EP | 2 144 510 | A1 | 1/2010 |
| EP | 1 749 080 | B1 | 3/2012 |
| EP | 2 540 279 | A1 | 1/2013 |
| WO | WO 97/40698 | A1 | 11/1997 |
| WO | WO 99/57990 | A1 | 11/1999 |
| WO | WO 2008/137871 | A1 | 11/2008 |

OTHER PUBLICATIONS

Iwanaga, K., et al., "Characterization of organogel as a novel oral controlled release formulation for lipophilic compounds," International Journal of Pharmaceutics, Mar. 30, 2010, 388(1-2):123-128. Abstract only, 2 pgs.

Lukyanova, L., et al., "Preparation and evaluation of microporous organogel scaffolds for cell viability and proliferation," Colloids and Surfaces B: Biointerfaces, Aug. 1, 2010, 79(1):105-112. Abstract only, 2 pgs.

Rogers, M.A., et al., "Nanostructuring fiber morphology and solvent inclusions in 12-hydroxystearic acid / canola oil organogels," Current Opinion in Colloid & Interface Science, Feb. 2009, 14(1):33-42. Abstract only, 2pgs.

Tamura, T., et al., "Effect of alkali metal ions on gel formation in the 12-hydroxystearic acid/soybean oil system," Journal of the American Oil Chemists' Society, Aug. 1994, 71(8):857-861. Abstract only, 4 pgs.

* cited by examiner

CANDLES COMPRISING VEGETABLE OIL THAT IS LOW IN POLYUNSATURATION AND GELLING AGENT

TECHNICAL FIELD

The present disclosure is directed to candle products comprising one or more high oleic vegetable oils that are low in polyunsaturation and a gelling agent. In some embodiments, the disclosure is directed to candle products comprising a fuel source, which in turn consists essentially of high oleic soybean oil and 12-hydroxystearic acid.

BACKGROUND

Typically candles comprise a wick and a fuel source. For most of recorded history, tallow and beeswax were used as the fuel source for candles, though this changed in the mid-1800s when candles were typically made from spermaceti and purified animal fats (stearin).

Today, most candles utilize paraffin wax as a fuel source. However, the use of paraffin wax may have a number of disadvantages. For example, paraffin wax is typically derived from petroleum, a non-renewable resource that is rapidly becoming more scarce and expensive. As a result, many manufacturers have turned to making candles using alternative fuel sources, such as natural waxes. Natural waxes are renewable and derived from plant or animal sources; vegetable oils are a member of this group. To be used in a candle, vegetable oils are typically hydrogenated, which reduces the unsaturation of the vegetable oils and converts them to opaque solids at room temperature. However, hydrogenation of vegetable oil may add cost to the production of candles.

Non-hydrogenated olive oil has been used to make some candles. Olive oil is naturally low in polyunsaturation, but has the disadvantage of high cost. Regular soybean oil has been used to make some candles, but this may also be disadvantageous since the resulting candles tend to burn with a low flame height, to consume the fuel source inefficiently, and to self-extinguish after only a relatively short burning period.

The aesthetics of gel candles are highly desirable, and as such, may command a premium market price. In the past, gel candles have been made with mineral oil and block copolymer gelling agents. However, this formulation may also be characterized by a number of problems, particularly, the risk of flashover.

Based upon the foregoing, it is clear that a need remains for candle products comprising a fuel source which may be, among other things, safe, renewable, inexpensive, non-toxic, clean and/or long-burning. It would be particularly desirable to address the need, while also providing for candles that are aesthetically pleasing including, but not limited to, allowing for a translucent look.

BRIEF DESCRIPTION

The present disclosure meets the aforementioned needs, by utilizing a novel fuel source to make candle products. Specifically, the present disclosure is directed to candle products comprising low polyunsaturated, high oleic vegetable oils. A high oleic (hereinafter, "HO") vegetable oil is defined herein to mean a vegetable oil having a fatty acid content, whether the fatty acids are free fatty acids and/or bound in triglyceride form, of:

(a) greater than 50%, greater than about 60%, greater than about 65%, greater than about 70%, or greater than about 75%, and less than about 99% of C18:1; and (b) a combined C18:2 and C18:3 content of less than about 30% or less than about 15%.

Useful low polyunsaturated vegetable oils may be selected from the group of: HO soybean oil; olive oil; HO sunflower oil; HO canola oil and combinations thereof. The low polyunsaturated vegetable oil is combined with a gelling agent, particularly, 12-hydroxystearic acid.

HO soybean oil may be a more cost effective fuel source than olive oil. Moreover, by virtue of utilizing HO soybean oil as opposed to regular oleic (hereinafter, "RO") soybean oil as a fuel source in candles, the present disclosure provides for candles that have a number of distinct advantages including, but not limited to: higher flame height, longer burn times and easily modified aesthetics such as modified scent and translucency.

BRIEF DESCRIPTION OF THE DRAWINGS

While the specification discloses certain aspects of the present invention, it is believed the same will be better understood from the following description taken in conjunction with the accompanying figures in which.

Figure 1:
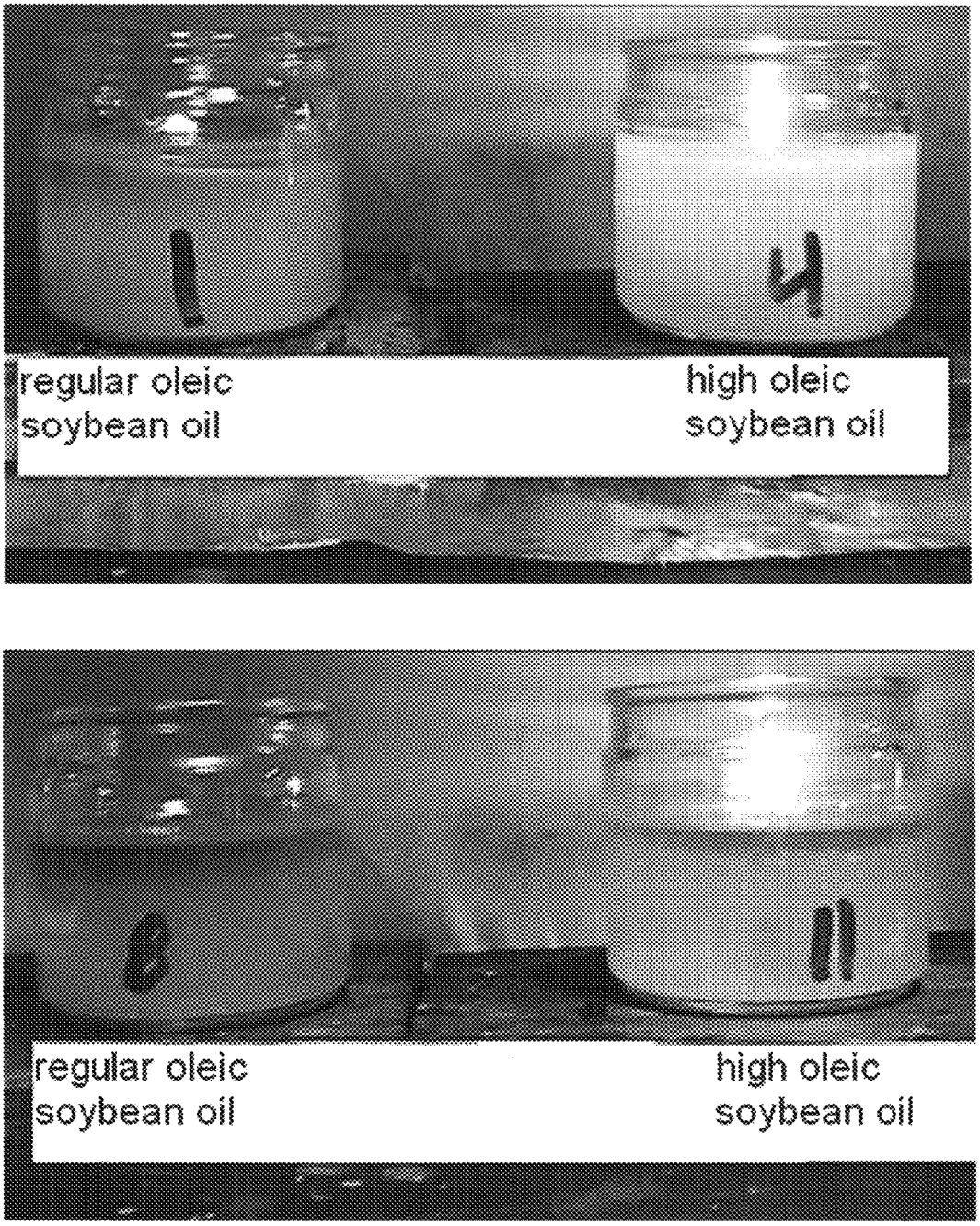
FIG. 1 shows photos of burning candles comprising HO soybean oil and RO soybean oil.

The application file contains at least one photo executed in color. Copies of this patent or patent application publication with color photo(s) will be provided by the Office upon request and payment of the necessary fee.

DETAILED DESCRIPTION

All percentages, ratios and proportions used herein are by weight percent of the composition, unless otherwise specified. All average values are calculated "by weight" of the composition or components thereof, unless otherwise expressly indicated.

"Candle product" is used to mean a product comprising a fuel source. Examples of candle products include candles and Melts (as defined below).

"Fuel source" is used herein to mean the portion of a candle product that is vaporized when a heat source, most commonly an open flame, is used to heat the candle product. Once vaporized, the fuel source may combine with oxygen in the atmosphere to maintain the open flame.

For clarity, it is noted that oleic acid is 18 carbons long with one double bond at carbon 9. The orientation around the double bond can be either cis (the two hydrogens are on the same side of the backbone) or trans (the hydrogens are on opposite sides of the back bone).

"High Oleic" or "HO" as used herein means oil having a fatty acid content, whether the fatty acids are free fatty acids and/or bound in triglyceride form, of:

(b) greater than 50%, greater than about 60%, greater than about 65%, greater than about 70%, or greater than about 75%, and less than about 99% of C18:1; and (b) a combined C18:2 and C18:3 content of less than about 30% or less than about 15%.

"Regular Oleic" or "RO" as used herein means oil having a fatty acid content, whether the fatty acids are free fatty acids and/or bound in triglyceride form, of about 50% or less C18:1.

The present disclosure meets the aforementioned needs, while also improving upon and solving problems associated with previous candle products by providing, among other things, a candle product comprising: (A) a fuel source and (B) a wick. The fuel source may in turn comprise: (I) Low Polyunsaturated, High Oleic Vegetable Oil; (II) Gelling Agent; and (III) Additional Components. Examples and Experimental Data relating to candles according to the present disclosure are also set forth below.

(A) Fuel Source

I. Low Polyunsaturated, High Oleic Vegetable Oil:

Low polyunsaturated vegetable oils for use in candles according to the present disclosure may be selected from the group of: HO soybean oil; olive oil; HO sunflower oil; HO canola oil and combinations thereof. Typical fatty acid compositions by weight percentage for the aforementioned oils are included in Table 1:

TABLE 1

| Fatty Acid Chain Length[1] | HO Soybean Oil (wt %) | HO Olive Oil (wt %) | HO Sunflower Oil (wt %) | HO Canola Oil (wt %) | RO Soybean Oil (wt %) |
|---|---|---|---|---|---|
| 16:0 | 6.5 | 10.6 | 3.8 | 3.4 | 11.3 |
| 18:0 | 4.2 | 3.6 | 4.1 | 2.5 | 3.4 |
| 16:1 | 0.8 | 0.5 | 3.8 | 3.4 | Trace |
| 18:1 | 71.2 | 77.2 | 78.4 | 76.8 | 23.1 |
| 18:2 | 12.0 | 7.2 | 11.3 | 7.8 | 55.8 |
| 18:3 | 2.5 | 0.9 | Trace | 2.6 | 6.4 |

[1]Number of carbon atoms:number of double bonds (e.g., 18:1 refers to oleic acid and 18:2 refers to linoleic acid).

Vegetable oils of use in candle products according to the present disclosure are high in monounsaturated fats and low in polyunsaturated fats. Vegetable oils of use are HO vegetable oils and have a fatty acid content, whether the fatty acids are free fatty acids and/or bound in triglyceride form, of:

(a) greater than 50%, greater than about 60%, greater than about 65%, greater than about 70%, or greater than about 75%, and less than about 99% of C18:1; and (b) a combined C18:2 and C18:3 content of less than about 30% or less than about 15%.

In some embodiments, the fuel source comprises from 30% to about 99%, from about 50% to about 95%, from about 60% to about 90%, from about 70% to about 90% or from about 70% to about 95% of HO vegetable oil. In some embodiments, the fuel source may comprise from about 96% to about 98% HO vegetable oil. In some embodiments, the fuel source may further comprise paraffin wax; in such embodiments, the fuel source may comprise from about 10% to about 90%, from about 20% to about 80% or from about 60% to about 70% of paraffin wax. In these embodiments, in addition to paraffin wax, the fuel source may also comprise from about 10% to about 90%, from about 20% to about 80% or from about 30% to about 40% of HO vegetable oil. In some embodiments, the fuel source may comprise from about 60% to about 70% paraffin and from about 30% to about 40% HO soybean oil.

Antioxidants such as butylated hydroxytoluene (BHT) and/or tert-butylhydroquinone (TBHQ) are commonly added to natural waxes at about 50 to about 100 ppm to extend the storage life of candle products. Without these antioxidants, natural waxes may readily increase in color (typically they become red), and may even polymerize when held in a molten state. Without wishing to be bound by theory, it is believed that the aforementioned combination of high monounsaturated fat and low polyunsaturated fat content provides for a good burning candle product that has good oxidative stability, which in turn, may eliminate the need to include antioxidants in the candles. For example, HO soybean oil for use in the present disclosure may have an oxidative stability of greater than 50 hours as measured using active oxygen method induction period (AOCS method Cd 12-57, which is incorporated herein by reference). As such, in some embodiments, candle products according to the present disclosure may be substantially free of antioxidants. In other words, the candle products may comprise less than about 100 ppm, or less than about 50 ppm or even 0 ppm antioxidants.

In some embodiments, the fuel source may be used to bind a fragrance in product executions that do not utilize a wick. Such wickless products are commonly referred to as "container melts" or "wax melts," which are collectively referred to herein as "melts." Melts comprise a fragrance bound in a base that may be present in a container, such as a cup. Melts may be heated by an electrical source to release the bound fragrance. Non-limiting examples of container melts include Aroma Melts™ from the Candle-lite® Company (Cincinnati, Ohio) and Scenterpiece® Easy MeltCups from the Yankee Candle® Company (South Deerfield, Mass.).

II. Gelling Agent:

Useful gelling agents may be selected from the group of: fatty alcohols, fatty acids, dicarboxylic acids and combinations thereof. Fatty alcohols may be selected from the group of: cetyl alcohol; stearyl alcohol; and combinations thereof. Fatty acids may be selected from the group of: stearic acid, palmitic acid; and combinations thereof. Dicarboxylic acids may be selected from the group of: adipic acid; sebacic acid; and combinations thereof. In general, the above gelling agents may be effective at levels from about 10% to about 40%, or from about 20% to about 30% by weight of the fuel source.

In some embodiments, the fatty acid may be 12-hydroxystearic acid (hereinafter, "HSA"). Compared to the aforementioned gelling agents, HSA may produce gels when present in the fuel source at much lower concentrations, and may produce gels that are more translucent. For example, HSA is found to produce gels with desired aesthetics at levels of from about 1% to about 10%, or from about 2% to about 3% by weight of the fuel source.

In some embodiments, the fuel source for candle products may comprise, or consist essentially of, HO soybean oil and 12-hydroxystearic acid. In some embodiments, the fuel source of the candle product may comprise from about 90 to about 99%, or from about 95% to about 98% HO soybean oil, and from about 1% to about 10%, or from about 2% to about 4% HSA. In embodiments in which a translucent candle product is desired, such as a glass-filled candle or melt, the fuel source of the candle product may be comprise about 97.5% HO soybean oil and about 2.5% HSA.

III. Additional Components:

Candle products according to the present disclosure may be readily modified to achieve desired aesthetics such as a good aroma and translucency. For example, the following may be readily incorporated into the fuel source: fragrances; colorants; UV additives; and combinations thereof. Standard candle product fragrances may readily go into solution. Fragrance loadings of 0 to about 20% are possible but fragrance loadings of about 2% to about 6% are more typical; these fragrances can be mixtures of natural and synthetic volatile compounds. Colorants can be dyes or pigments or more typically, combinations of one or more dyes and pigments. Overall concentration of colorants can be between 0% and about 1%, between about 0.001 and about 0.05%; lower amounts may lead to dull washed out colors while higher amounts may lead to burn issues. UV additives may be added to protect the candle product color from fading; these are typically blends of benzophenones, benzotriazoles and/or other compounds known to those in the art to protect dyes and fragrances from shifting colors. The UV package may comprise from 0 to about 1.0%, or from about 0.2 to 0.5% by weight of the fuel source.

In some embodiments, the candle products may be translucent and in some embodiments, they may be opaque. In some embodiments, the candle products may have a creamy opaque appearance. Any suitable method for imparting a creamy opaque appearance to candle products may be used. In some exemplary embodiments, the creamy opaque appearance may be achieved by blending fatty acids into the fuel source. For example, in some embodiments, from about 5% to about 10% stearic acid may be added to the fuel source to form a candle product that has a smooth, creamy, opaque look. Whereas in other embodiments, the fuel source may be modified by adding from about 20% to about 30% stearic acid to provide the candle with a crystalline, mottled look.

In some embodiments the fuel source may be blended with paraffin wax to modify the appearance. As paraffin wax is added to the fuel source, the translucency and brightness of its color decreases and the candle product becomes more opaque and creamy. At low levels of paraffin, for example from about 10% to about 20%, a rich vibrant looking candle product is formed. In embodiments in which paraffin content is increased to from about 60% to about 80%, a creamier looking candle product is formed.

If a non-translucent (opaque) look is desired, typical candle additives can be used to further modify the firmness of the candle product. In addition, or in the alternative, fragrance holding characteristics can be modified. For example, additives may be added to the fuel source, including additives selected from the group of: sterically hindered polyalphaolefins, examples of which include Vybar™ from Baker Hughes (Houston, Tex.) and Polyboost™ from Clarus Specialty Polymers (Rock Hill, S.C.); polyethylene copolymerized with vinyl acetate waxes, examples of which include AC® polyethylene waxes from Honeywell (Morristown, N.J.); microcrystalline waxes; emulsifiers, including like monoglycerides and/or diglycerides; polyethylene glycol; sorbitan esters; and combinations thereof.

B. Wick

For candle products comprising a wick, the wick may comprise any suitable material. For example, the wick may comprise: cotton, rayon, nylon, hemp, wood, and combinations thereof. The wick may be of any suitable shape and/or construction including: woven, braided, knitted, flat, square, round, cylindrical, and combinations thereof. In some embodiments, the wick may also include a wick core to help support the wick. The wick core may be composed of any suitable material. Non-limiting materials of use may be selected from the group of: cotton, metal, paper, rayon, polyethylene fiber, and combinations thereof. In some embodiments, the wick may be coupled with a wick clip to help support the wick; in these embodiments, the wick and clip may be glued into the container or be free standing. The use of a core with a wick hole may ensure the wick remains straight. In some embodiments, multiple wicks may be used in any suitable geometric configuration.

Exemplary candle products according to the present disclosure may be made as follows. HO vegetable oil, gelling agent and optionally, additional components, are heated with stirring in a beaker with until it reaches 170° F., which is the minimum temperature typically needed to melt the HSA. Higher temperatures can also be used, but may lead to longer cooling and solidification times, and may also be detrimental to the fragrance. After the mixture becomes homogenous, a fragrance is added and the mixture is transferred to the final container. The container can be of any suitable material. Suitable materials may be selected from the group of: glass, paper, plastic, metal and combinations thereof. A wick is added and the candle is allowed to cool. The wick can be held in placed by gluing or the use of a core. Cooling can be accelerated by the employment of forced air or the use of a heat exchanger before the mixture is transferred to the container to yield a translucent candle.

EXAMPLES

Example 1

A composition comprising 94.2% HO soybean Oil, 2.5% HSA, 0.3% UV additives (0.15% of a benzotriazole, 2-(2-hydroxy-5-tert-octylphenyl)benzotriazole CAS#3147-75-9 and 0.15% of a benzophone, 2-hydroxy-4-4-n-octaxybenophenone CAS#1843-05-6) and 0.01% of a red dye (Uniflame Liquid Red by United Color Mfg, (Newtown, Pa.)) are heated with stirring in a beaker to 170° F. After the mixture becomes homogenous, a fragrance is added (3% Warm Apple Pie 922994 from Symrise Inc. (Teterboro, N.J.)), and the mixture is transferred to a glass container. A wick is added and the candle is allowed to cool. A candle having a translucent appearance is obtained.

Example 2

A composition comprising 84.7% HO soybean oil, 10% triple pressed stearic acid, 2% HSA, 0.3% UV additives (0.15% of a benzotriazole, 2-(2-hydroxy-5-tert-octylphenyl) benzotriazole CAS#3147-75-9 and 0.15% of a benzophone, 2-hydroxy-4-4-n-octaxybenophenone CAS#1843-05-6) and 0.02% of a red dye (Uniflame Liquid Red by United Color Mfg. (Newtown, Pa.)) are heated with stirring in a beaker to 170° F. After the mixture becomes homogenous, a fragrance is added (3% Warm Apple Pie 922994 from Symrise, (Teterboro, N.J.)) and the mixture is transferred to a glass container. A wick is added and the candle is allowed to cool. A candle having a creamy and opaque appearance is obtained.

Example 3

A composition comprising 74.7% HO soybean oil, 20% triple pressed stearic acid, 2% HSA, 0.3% UV additives (0.15% of a benzotriazole, 2-(2-hydroxy-5-tert-octylphenyl) benzotriazole CAS#3147-75-9 and 0.15% of a benzophone, 2-hydroxy-4-4-n-octaxybenophenone CAS#1843-05-6) and 0.02% of a red dye (Uniflame Liquid Red by United Color Mfg, Newtown, Pa.) are heated with stirring in a beaker to 170° F. After the mixture becomes homogenous, a fragrance is added (3% Warm Apple Pie 922994 from Symrise, (Teterboro, N.J.)) and the mixture is transferred to a glass container. A wick is added and the candle is allowed to cool. A candle having a crystalline appearance is obtained.

Example 4

A composition comprising 38% HO soybean oil, 56.7% paraffin wax, 2% HSA, 0.3% UV additives (0.15% of a benzotriazole, 2-(2-hydroxy-5-tert-octylphenyl)benzotriazole CAS#3147-75-9 and 0.15% of a benzophone, 2-hydroxy-4-4-n-octaxybenophenone CAS#1843-05-6) and 0.02% of a red dye (Uniflame Liquid Red by United Color Mfg. (Newtown, Pa.)) are heated with stirring in a beaker to 170° F. After the mixture becomes homogenous, a fragrance is added (3% Warm Apple Pie 922994 from Symrise Inc. (Teterboro, N.J.)) and the mixture is transferred to a glass container. A wick is added and the candle is allowed to cool. A candle having a creamy opaque appearance is obtained.

Any of the aforementioned examples may be made into melts by simply selecting the appropriate container and eliminating the wick from the above procedure.

Data:

Candles that comprise HO soybean oil per the present disclosure provide for surprisingly better burn results than candles comprising RO vegetable oil. For example, burn data are taken for test candles that are identical in every aspect except that some are made with HO soybean oil and some are made with RO soybean oil. More particularly, two sets of three HO soybean oil candles (respectively dyed pink and blue), and two sets of three RO soybean oil candles (respectively dyed pink and blue) are made as follows: In a beaker with stirring, 94.4% vegetable oil, 2.5% HSA and 0.02% of dye blend is heated to 170° F. The heat is turned off and 3.0% fragrance oil is added and the mixture is poured into an open-topped glass container. The wick is then added and candle is allowed to cool. For the blue candles in Table 3 and FIGS. 1 & 2, the dye used is Blue #DF11819 from French Color & Fragrance Co., and the fragrance is Crystal Waters 413530BD from Firmenich Inc. For the pink candles in Table 2 and FIGS. 1 & 2 the dye used is Fast Magenta #C708 from Pylam Industries and the fragrance is Pink Sand Dunes 403575 from Firmenich Inc. The wick is a cotton braided construction with "high-performance fiber" for added rigidity and predictable wick posture commercially available as HTP 105 from Atkins & Pearce.

The burn procedure outlined in ASTM Standard F2417-11, which is incorporated by reference, is followed. The candles are burned in an ASTM Standard F2417-11 compliant environment.

The burn procedure for each of the test candles is as follows. First, the wick is trimmed so that it extends ¼ inch above the top of the fuel source. For the 4-1-4 burn cycle, the wick is then lit and the candle allowed to burn first for a four hour period or until it self-extinguishes. If the candle is still burning, the flame height is measured, and the flame is then extinguished. The test candle is allowed to cool for at least one hour and the process is repeated seven times or until the candle will not re-light for a total of 32 burn hours. For the extended burn cycle, the candles are lit and allowed to burn 20 hr., while the flame heights are measured at the same time points that the flame heights for the 4-1-4 burn cycled candles are measured. If the flame self-extinguishes it is relit when the 4-1-4 burn cycle candles are lit.

The percentage of wax consumption of a candle is determined as follows. The initial weight of the candle (including fuel source, wick and wick clip) before burning is measured. After burning of the candle is completed, a final weight of the candle (including fuel source, wick and wick clip) is measured. The percentage of wax consumption is then determined using the following mathematical formula:

$$\%\ \text{wax consumption} = \left(\frac{(\text{initial weight of candle} - \text{final weight of candle})}{\text{initial weight of candle}}\right) \times 100$$

The resulting data are set forth in Tables 2 and 3. Notably, the test candles are identified in each of Tables 2 and 3, and in FIGS. 1 and 2, by a common sample number (e.g., Sample #1 in Table 2 is the same test candle as Sample #1 in each of Table 3, FIG. 1 and FIG. 2).

TABLE 2

| Sample Number (n = 8) | Description | Burn cycle | Burn Hours | GPH[2] | % Wax Consumption | Flame Height[3] Min | Flame Height Max |
|---|---|---|---|---|---|---|---|
| 1 | Pink Candle | 4-1-4 | 32 | 1.48 | 39.2 | Self-extinguish | 0.625 |
| 2 | RO | 4-1-4 | 32 | 1.62 | 43.1 | 0.375 | 0.50 |
| 3 | Soybean Oil | Extended | 40 | 1.85 | 49.1 | 0.375 | 0.625 |
| 4 | Pink Candle | 4-1-4 | 32 | 2.73 | 72.6 | 0.50 | 1.25 |
| 5 | HO | 4-1-4 | 32 | 2.51 | 66.6 | 0.50 | 1.00 |
| 6 | Soybean Oil | Extended | 40 | 2.98 | 79.3 | 0.50 | 1.25 |
| 7 | Blue Candle | 4-1-4 | 32 | 1.01 | 25.8 | Self-extinguish | 0.75 |
| 8 | RO | 4-1-4 | 32 | 1.06 | 28.2 | Self-extinguish | 0.75 |
| 9 | Soybean Oil | Extended | 40 | 0.88 | 23.32 | Self-extinguish | 0.5 |
| 10 | Blue Candle | 4-1-4 | 32 | 2.48 | 65.9 | 0.5 | 1.00 |
| 11 | HO | 4-1-4 | 32 | 2.52 | 66.7 | 0.5 | 1.25 |
| 12 | Soybean Oil | Extended | 40 | 2.64 | 70.2 | 0.5 | 1.25 |

[2]"GPH" means grams of fuel source consumed per hour.
[3]Flame Height is recorded in inches.

As can be seen in Table 2, the rate of fuel source consumption (GPH), the percentage of fuel source consumption (% Wax Consumption) and the minimum and maximum flame heights are all significantly greater for the candles comprising HO soybean oil (Samples 4-6 and 10-12) as compared to the candles comprising RO soybean oil (Samples 1-3 and 7-9).

TABLE 3[4]

| | DATE | | | | | | | |
|---|---|---|---|---|---|---|---|---|
| | 2-4-15 | 2-4-15 | 2-4-15 | 2-4-15 | 2-4-15 | 2-5-15 | 2-5-15 | 2-5-15 |
| | TIME | | | | | | | |
| Sample Number | 9 am Flame Height | 11 am Flame Height | 2 p Flame Height | 4 p Flame Height | 9 p Flame Height | 2 a Flame Height | 11 a Flame Height | 4 p Flame Height |
| 1 | 0.625 | 0.375 | 0.5 | 0.375 | 0.375 | 0.375 | 0.5 | Self-extinguish |
| 2 | 0.5 | 0.375 | 0.5 | 0.375 | 0.5 | 0.5 | 0.5 | 0.375 |
| 3 | 0.5 | 0.5 | 0.5 | 0.5 | 0.5 | 0.375 | 0.625 | 0.375 |
| 4 | 1.25 | 0.75 | 1 | 0.75 | 0.625 | 0.75 | 0.625 | 0.5 |
| 5 | 1 | 0.625 | 1 | 0.75 | 1 | 0.875 | 0.625 | 0.5 |
| 6 | 1.25 | 0.75 | 0.875 | 1 | 1 | 0.875 | 0.625 | 0.5 |
| 7 | 0.375 | Self-extinguish | Self-extinguish | Self-extinguish | Self-extinguish | Self-extinguish | 0.375 | 0.5 |
| 8 | 0.75 | Glow | 0.375 | 0.25 | 0.25 | Glow | Self-extinguish | Self-extinguish |
| 9 | 0.5 | Glow | Self-extinguish | Self-extinguish | Glow | Self-extinguish | Self-extinguish | Self-extinguish |
| 10 | 1 | 0.625 | 1 | 0.75 | 1 | 0.875 | 0.5 | 0.5 |
| 11 | 1.25 | 0.625 | 0.875 | 0.875 | 1 | 1 | 0.5 | 0.5 |
| 12 | 1.25 | 0.75 | 0.875 | 0.75 | 0.875 | 1 | 0.625 | 0.5 |

[4]Flame Height is recorded in inches.

As can be seen in Table 3, the flame heights of RO soybean oil candles diminish after the first 4-hour burn cycle. The RO soybean oil candles continue to struggle for the rest of the test as seen by the glowing and self-extinguishing flame height recordings. By contrast, the HO soybean oil candles burn with higher and more constant flame heights until the fuel runs out (i.e., all the fuel source is consumed).

Figure 2:
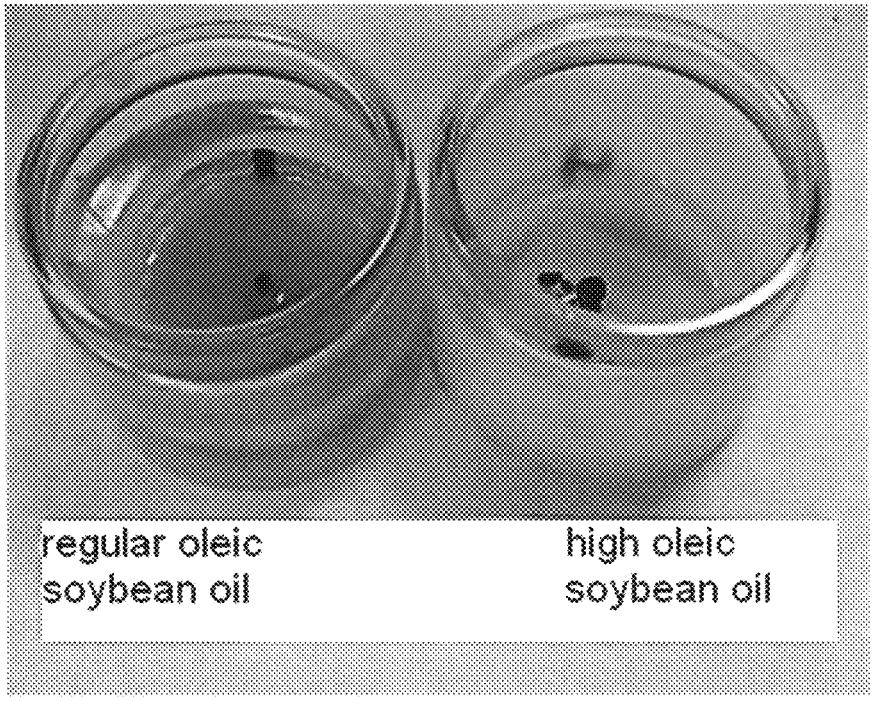
FIG. 2 shows photos of burned candles comprising HO soybean oil and RO soybean oil.
Figure 2:
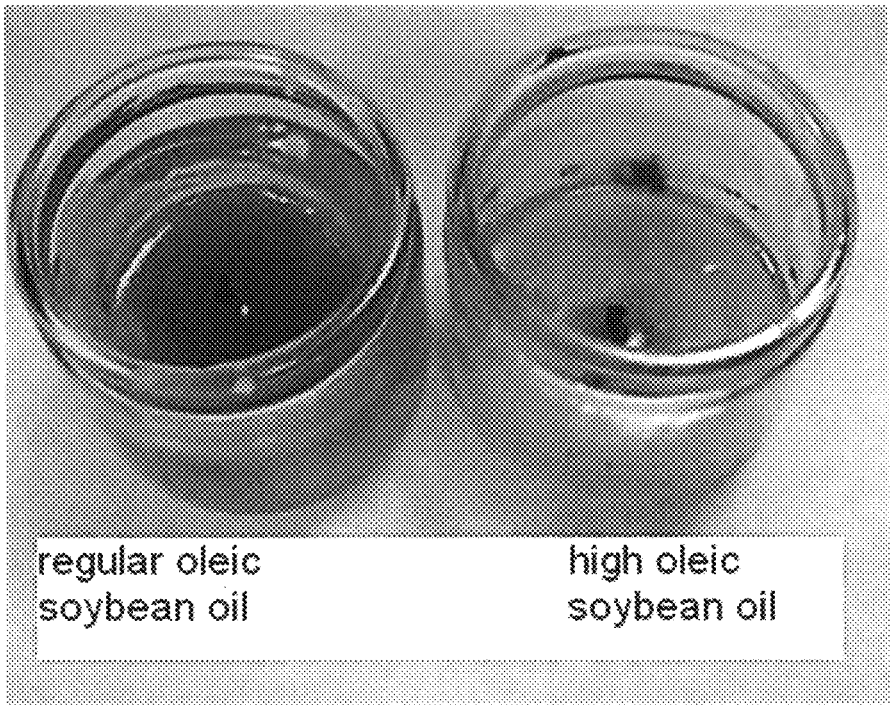

The superior performance of test candles comprising HO soybean oil as compared to test candles comprising RO soybean oil is also demonstrated in reference to FIGS. 1 and 2. In particular, FIG. 1 shows four test candles: Samples 1 and 8, which comprise RO soybean oil and Samples 4 and 11, which comprise HO soybean oil. As can be seen in FIG. 1, the candles comprising HO soybean oil burn with a higher flame height and as a consequence are brighter.

FIG. 2 shows the same four test candles after they have been burned for the eight four-hour cycles. From FIG. 2 it is clear that the candles comprising HO soybean oil burned better, i.e., more of the fuel was consumed as demonstrated by the lack of tunneling. In addition, the melt pool of the HO soybean oil went all the way to the glass container, whereas the RO soybean oil left about ¼ inch of wax on the sides of the glass container. The increased oxidation stability of the HO soybean oil over RO soybean oil may be seen in the comparative colors of the melt pool: the RO soybean oil melt pool darkened whereas the HO soybean oil melt pool remained its original color.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All numerical ranges disclosed herein are inclusive and combinable.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A candle product comprising:

(a) a fuel source comprising a high oleic vegetable oil comprising by weight percentage a fatty acid content of free fatty acids and/or fatty acids bound in triglyceride form of:

i. greater than 50% and less than about 99% of C18:1; and ii. a combined C18:2 and C18:3 content of less than about 30%; and (b) gelling agent.

2. The candle product of claim 1, the high oleic vegetable oil comprising by weight percentage a fatty acid content of free fatty acids and/or fatty acids bound in triglyceride form of:

(a) greater than 75% and less than about 99% of C18:1; and (b) a combined C18:2 and C18:3 content of less than about 25%.

3. The candle product of claim 1, wherein the high oleic vegetable oil is selected from the group of: HO soybean oil; olive oil; HO sunflower oil; HO canola oil; and combinations thereof.

4. The candle product of claim 1, wherein the gelling agent is selected from the group of: fatty alcohols; fatty acids; dicarboxylic acids and combinations thereof.

5. The candle product of claim 4, wherein the gelling agent is 12-hydroxystearic acid.

6. The candle product of claim 5, wherein the candle product comprises from about 1% to about 10% 12-hydroxystearic acid.

7. The candle product of claim 1, wherein the candle product consists essentially of high oleic soybean oil and 12-hydroxystearic acid.

8. The candle product of claim 1, wherein the fuel source further comprises from about 5% to about 30% stearic acid.

9. The candle product of claim 1, wherein the fuel source further comprises from about 60% to about 80% paraffin.

10. The candle product of claim 1, wherein the fuel source comprises less than about 100 ppm of antioxidants.

11. The candle product of claim 1, wherein the candle product is a candle comprising a wick.

12. The candle product of claim 1, wherein the candle product is a wickless candle product.

13. A candle product comprising:

(a) a fuel source comprising:

i. high oleic vegetable oil comprising by weight percentage a fatty acid content of free fatty acids and/or fatty acids bound in triglyceride form of:

1. greater than 50% and less than about 99% of C18:1;

2. a combined C18:2 and C18:3 content of less than about 30%;

ii. paraffin wax; and (b) gelling agent.

14. The candle product of claim 13, wherein the fuel source comprises from about 30% to about 40% soybean oil and from about 60% to about 70% paraffin.

15. The candle product of claim 13, wherein the high oleic vegetable oil is soybean oil and the gelling agent is 12-hydroxystearic acid.

16. The candle product of claim 13, further comprising UV additive.

17. The candle product of claim 13, further comprising an additive selected from the group of: sterically hindered polyalphaolefin, polyethylene copolymerized with vinyl acetate waxes microcrystalline waxes; emulsifiers; polyethylene glycol; sorbitan esters; and combinations thereof.

18. The candle product of claim 13, wherein the candle product is a candle comprising a wick.

19. The candle product of claim 13, wherein the candle product is a wickless candle product.

20. A candle product consisting essentially of:

(a) from about 90% to about 99% high oleic soybean oil comprising by weight percentage a fatty acid content of free fatty acids and/or fatty acids bound in triglyceride form of:

i. greater than 50% and less than about 99% of C18:1;

ii. a combined C18:2 and C18:3 content of less than about 30%; and (b) from about 1% to about 10% 12-hydroxystearic acid.

21. A method of making a candle product comprising the step of blending:

(a) a fuel source comprising a high oleic vegetable oil comprising by weight percentage a fatty acid content of free fatty acids and/or fatty acids bound in triglyceride form of:

i. greater than 50% and less than about 99% of C18:1; and ii. a combined C18:2 and C18:3 content of less than about 30%; and (b) gelling agent.

* * * * *